US009322250B2

(12) United States Patent
Johnson

(10) Patent No.: US 9,322,250 B2
(45) Date of Patent: Apr. 26, 2016

(54) SYSTEM FOR GAS HYDRATE PRODUCTION AND METHOD THEREOF

(71) Applicant: Michael H. Johnson, Katy, TX (US)

(72) Inventor: Michael H. Johnson, Katy, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 231 days.

(21) Appl. No.: 13/967,763

(22) Filed: Aug. 15, 2013

(65) Prior Publication Data

US 2015/0047850 A1 Feb. 19, 2015

(51) Int. Cl.

| | |
|---|---|
| ***E21B 43/12*** | (2006.01) |
| ***E21B 34/08*** | (2006.01) |
| *E21B 43/01* | (2006.01) |

(52) U.S. Cl.

CPC ..... *E21B 43/12* (2013.01); *E21B 2043/0115* (2013.01)

(58) Field of Classification Search

CPC ..... E21B 43/08; E21B 43/128; E21B 43/122; E21B 43/12; E21B 34/08

See application file for complete search history.

(56) References Cited

U.S. PATENT DOCUMENTS

| | | | | |
|---|---|---|---|---|
| 3,987,849 | A * | 10/1976 | Mott | E21B 34/08 137/458 |
| 6,220,079 | B1 * | 4/2001 | Taylor | E21B 17/18 73/37 |
| 6,854,534 | B2 * | 2/2005 | Livingstone | E21B 17/203 175/213 |
| 6,999,883 | B1 * | 2/2006 | Brady | B09B 1/006 702/50 |
| 7,066,283 | B2 * | 6/2006 | Livingstone | E21B 7/04 175/215 |
| 7,222,673 | B2 | 5/2007 | Graue et al. | |
| 7,240,739 | B2 * | 7/2007 | Schoonderbeek | E21B 34/08 166/227 |
| 7,530,392 | B2 * | 5/2009 | Sugiyama | E21B 23/02 166/250.07 |
| 7,537,056 | B2 | 5/2009 | MacDougall | |
| 7,789,157 | B2 * | 9/2010 | Zupanick | E21B 33/128 166/105 |
| 7,789,158 | B2 * | 9/2010 | Zupanick | E21B 33/128 166/105.5 |
| 7,866,402 | B2 * | 1/2011 | Williamson, Jr. | E21B 21/103 166/319 |
| 7,886,820 | B2 | 2/2011 | Onodera et al. | |
| 7,926,573 | B2 * | 4/2011 | Swan | E21B 21/103 166/319 |
| 7,971,649 | B2 * | 7/2011 | Zupanick | E21B 33/128 166/105 |
| 8,096,363 | B2 * | 1/2012 | Williamson, Jr. | E21B 21/103 166/319 |
| 8,132,624 | B2 | 3/2012 | Johnson et al. | |

(Continued)

OTHER PUBLICATIONS

Caroly Ruppel "Methane Hydrates and the Future of Natural Gas", Supplementary Paper 4, U.S. Geological Survey, Woods Hole, MA, MITEI Natural Gas Report, Supplementary paper on Methane Hydrates, 2011, pp. 1-25.

(Continued)

*Primary Examiner* — Catherine Loikith
*Assistant Examiner* — Crystal J Miller
(74) *Attorney, Agent, or Firm* — Cantor Colburn LLP

(57) ABSTRACT

A system for gas hydrate production. The system includes a tubular having a plurality of ports. The plurality of ports includes a first port configured to automatically open at a first differential pressure, and to remain closed at differential pressures below the first differential pressure. A second port configured to remain closed at the first differential pressure, and to automatically open at a second differential pressure greater than the first differential pressure; wherein the second port is located uphole of the first port. Also included is a method of improving methane hydrate production.

18 Claims, 2 Drawing Sheets

(56) References Cited

U.S. PATENT DOCUMENTS 8,151,881 B2 4/2012 Johnson et al.
8,528,648 B2 * 9/2013 Zupanick ..... E21B 33/128 166/263
8,555,985 B2 * 10/2013 Metcalfe ..... E21B 33/1277 166/228
8,607,873 B2 * 12/2013 Aadnoy ..... E21B 34/08 166/320
8,714,266 B2 * 5/2014 Dykstra ..... E21B 34/08 166/305.1
8,757,273 B2 * 6/2014 Themig ..... E21B 34/102 137/462
8,955,601 B2 * 2/2015 Osborne ..... E21B 34/08 166/334.3
9,027,654 B2 * 5/2015 Osborne ..... E21B 34/08 166/373
2003/0155156 A1 * 8/2003 Livingstone ..... E21B 17/203 175/57
2004/0104052 A1 * 6/2004 Livingstone ..... E21B 7/04 175/61
2004/0168800 A1 9/2004 Sask
2006/0032637 A1 2/2006 Ayoub et al.
2006/0196668 A1 * 9/2006 Burge ..... E21B 23/006 166/313
2006/0249291 A1 * 11/2006 MacDougall ..... E21B 43/12 166/373
2007/0062704 A1 * 3/2007 Smith ..... E21B 43/24 166/303
2007/0114038 A1 * 5/2007 Daniels ..... E21B 43/122 166/372
2007/0227731 A1 10/2007 Contant
2009/0032244 A1 * 2/2009 Zupanick ..... E21B 33/128 166/105.5
2009/0032245 A1 * 2/2009 Zupanick ..... E21B 33/128 166/105.5
2009/0095463 A1 * 4/2009 Swan ..... E21B 21/103 166/53
2009/0095486 A1 * 4/2009 Williamson, Jr. ..... E21B 21/103 166/373
2009/0188665 A1 * 7/2009 Tubel et al. ..... 166/250.01
2010/0175895 A1 * 7/2010 Metcalfe ..... E21B 33/1277 166/382
2010/0319908 A1 * 12/2010 Zupanick ..... E21B 33/128 166/105.5
2011/0056700 A1 3/2011 Mathiesen et al.
2011/0067878 A1 * 3/2011 Aadnoy ..... E21B 34/08 166/321
2011/0079393 A1 * 4/2011 Williamson, Jr. ..... E21B 21/103 166/321
2011/0100643 A1 * 5/2011 Themig ..... E21B 34/102 166/373
2011/0259428 A1 * 10/2011 Osborne ..... E21B 34/08 137/1
2011/0300008 A1 * 12/2011 Fielder et al. ..... 417/410.3
2012/0097401 A1 4/2012 Hester
2012/0199210 A1 * 8/2012 Osborne ..... E21B 34/08 137/1
2013/0180727 A1 7/2013 Dykstra et al.
2013/0309888 A1 * 11/2013 Nicholson ..... E21B 36/00 439/271
2014/0048250 A1 * 2/2014 Osborne ..... E21B 34/08 166/105
2015/0027697 A1 * 1/2015 Wang ..... E21B 43/24 166/272.3
2015/0068739 A1 * 3/2015 Johnson et al. ..... 166/250.15
2015/0068742 A1 * 3/2015 Johnson et al. ..... 166/276
2015/0068760 A1 * 3/2015 Johnson et al. ..... 166/369

OTHER PUBLICATIONS

International Search Report and Written Opinion; International Application No. PCT/US2014/047207; International Filing Date: Jul. 18, 2014; Date of Mailing: Nov. 25, 2014; 18 pages.

Marco J. Castaldi, et al. "Down-hole combustion method for gas production from methan hydrates", ScienceDirect Journal of Petroleum Science and Engineering 56 (2007) 176-185; Mar. 3, 2006, Elsevier B. V.

* cited by examiner

SYSTEM FOR GAS HYDRATE PRODUCTION AND METHOD THEREOF

BACKGROUND

In the completion and production industry for natural resources, the formation of boreholes for the purpose of production or injection of fluid is common. The boreholes are used for exploration or extraction of natural resources such as hydrocarbons, oil, gas, water, and alternatively for CO2 sequestration.

Production of methane hydrates has garnered interest as of late due to the large estimates of gas hydrate resources and the growing need to satisfy alternative energy demands. Methane hydrate includes water molecules formed in a cage like structure around methane molecules in low temperature and high pressure environments, such as permafrost zones in polar regions and layers within several hundred meters of the seafloor of an ocean. One means of producing methane hydrate involves reducing pressure in the wellbore such that the hydrates can disassociate in methane and water in order to extract the methane gas. That is, methane hydrate dissociates into methane gas and water when depressurized. Reducing the pressure in the wellbore can be accomplished using gas lift, rod pump, and electrical submersible pumping ("ESP"). These known mechanisms for lowering bottom hole pressure decrease the pressure to the entire interval of the wellbore.

The art would be receptive to improved alternative devices and methods for methane hydrate production.

BRIEF DESCRIPTION

A system for gas hydrate production, the system including a tubular having a plurality of ports, the plurality of ports includes a first port configured to automatically open at a first differential pressure, and to remain closed at differential pressures below the first differential pressure; and, a second port configured to remain closed at the first differential pressure, and to automatically open at a second differential pressure greater than the first differential pressure; wherein the second port is located uphole of the first port.

A downhole tubular including a first port configured to provide fluidic access between an interior and an exterior of the tubular; a first spring valve configured to open and close the first port, the first spring valve having a first spring with a first spring constant; a second port uphole of the first port, the second port configured to provide fluidic access between the interior and the exterior of the tubular; and, a second spring valve configured to open and close the second port, the second spring valve having a second spring with a second spring constant greater than the first spring constant.

A method of improving methane hydrate production, the method including inserting a ported tubular into a borehole; aligning first and second ports with at least one band of methane hydrate, the second port positioned uphole of the first port; opening the first port when a first differential pressure between an interior of the tubular and the at least one band of methane hydrate is reached; maintaining the second port in a closed condition at the first differential pressure; and, opening the second port at a second differential pressure greater than the first differential pressure.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
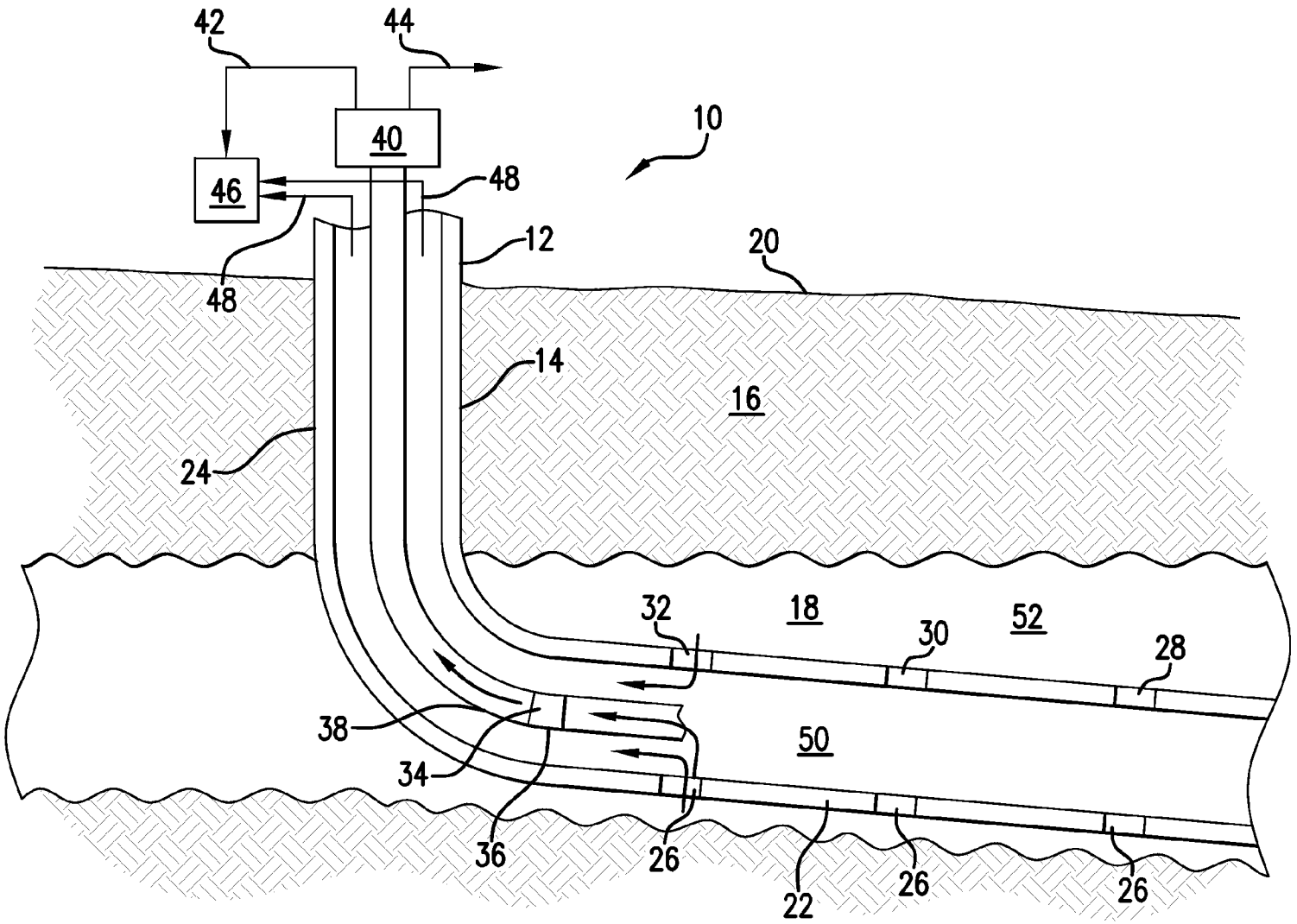
FIG. 1 shows a cross-sectional diagram of an exemplary embodiment of a system for gas hydrate production.

With reference to FIG. 1, a system 10 for improving gas hydrate production, and in particular methane hydrate production, is shown. The system 10 includes a tubular 12 configured to pass within a borehole 14 through a formation 16, the formation 16 containing at least one identified geological layer or band of gas hydrate 18, such as methane hydrate. The surface 20 of the formation 16 may be a subsea floor or a surface of continental rocks in a polar region (permafrost). In the case where the surface 20 is a subsea floor, it should be understood that the tubular 12, or an extension connected thereto, would be extended through a body of water to a rig at a surface location of the water.

The illustrated tubular 12 includes a single lateral portion 22 that extends from a vertical portion 24. The tubular 12 may alternatively include only the vertical portion 24, or may include a plurality of lateral portions 22. The tubular 12 includes a plurality of ports 26 aligned with the band of gas hydrate 18. While only one band of gas hydrate 18 is illustrated, alternatively the tubular 12 may pass through a plurality of bands of gas hydrate, in which case the tubular 12 may include at least one port 26 aligned with each band of gas hydrate 18. For exemplary purposes, three ports 28, 30, 32 are numbered in FIG. 1, with port 28 being at a most downhole location among the ports 26, and port 32 being at a most uphole location among the ports 26. Of course, it should be understood that any number of ports 26 may be employed.

The system 10 further includes a pressure reducing mechanism 34 to lower bottom hole pressure, such as, but not limited to, gas lift, rod pump, and ESP. In an exemplary embodiment, an ESP 36 is shown within the tubular 12 and disposed uphole of the ports 26. The ESP 36 pumps water and gas that enter the tubular 12 through the ports 26 to the surface 20. The ESP 36 may additionally be provided with a separator to separate the gas from the water as it passes therethrough, in which case at least a portion of the water need not be lifted all the way to the surface but may instead be recycled to the downhole side of the ESP 36 for pump performance. Also, if needed, the ESP 36 may additionally be provided with water or other fluid from the surface 20 to stabilize pump performance and provide the necessary pressure reduction to create the disassociation of gas hydrate by depressurization.

Due to the operation of the pressure reducing mechanism 34, the pressure on the downhole side of the pressure reducing mechanism 34 is lower than the pressure on the uphole side of the pressure reducing mechanism 34. The reduced pressure within the tubular 12 is shared with an area of the gas hydrate 18 proximate the respective port 26, thus reducing the pressure of that area. With a release of pressure in methane hydrate, methane gas dissociates from the water molecules and a mixture of methane gas and water flows into the tubular 12 through the port 26. A conduit 38 carrying the pressure reducing mechanism 34 within the tubular 12 pumps the gas and water to a separator 40 at the surface 20 for recovery of the gas as indicated by arrow 42 and discharge or recycling of the water, as indicated by arrow 44. As noted above, the water may be redirected into the tubular 12 for proper operation of the ESP 36 if needed, or may alternatively be recycled. The gas may be sent to a gas storage area 46. The gas from the separator 40 may be combined with gas that escapes the tubular 12 via an exterior of the conduit 38, as indicated by arrows 48, into the gas storage area 46.

The formation pressure surrounding the illustrated tubular 12 in the interval of the ports 26 will be substantially constant, and the pressure reducing mechanism 34 will reduce the internal pressure of the tubular 12 across the entire interval of ports 26 to be less than the pressure in the gas hydrate 18. Thus, in a conventional system, the differential pressure across each port is initially constant. It has been determined that under these circumstances, the most uphole port 32 in the tubular 12 (the port located closest to the exit of the tubular 12) will be the most productive in disassociating the hydrates from the methane firstly and will eventually cause an imbalance in productivity across the zone. The differential pressure is the difference between the pressure outside the tubular 12 and the pressure inside the tubular 12, and with this normal differential pressure distribution across the interval, disassociation will occur primarily through port 32. To solve this issue, in exemplary embodiments described herein, the ports 26 across the interval are distributed to operate at successively increasing differential pressures across the methane hydrate productive interval, from downhole to uphole, in a manner that increases productivity across the entire interval. For example, the port 28 will operate at a first differential pressure between the interior 50 of the tubular 12 and the band of gas hydrate 18. A port 26 further uphole, such as port 30, will operate at a second differential pressure greater than the first differential pressure. A port 26 further uphole from port 30, such as port 32, will in turn operate at a third differential pressure greater than the second differential pressure, and so on. Again, while ports 26 are shown relatively close to each other for ease of illustration, they may be separated in different zones and may be positioned within different bands of gas hydrate 18. Ports 26 that are in relatively close proximity to each other along a longitudinal length of the tubular 18 may operate at substantially the same differential pressure as each other, so long as it is determined that the most uphole port among the closely positioned ports 26 does not compromise the productivity of the downhole ports among the closely positioned ports.

When the tubular 12 is run into position within the borehole 14 and the pressure reducing mechanism 34 reduces the pressure within the interior 50 of the tubular 12, the port 28 will operate at the first differential pressure, and ports 30, 32 will remain closed. When port 28 is opened to allow the entry of gas and water from the gas hydrate 18 into the tubular 12, the evolved gas into the tubular 12 will decrease the weight of the liquid column within the tubular 12, which serves to lower the pressure within the interior 50 of the tubular 12 even further. For example, methane gas is not soluble in water, and therefore serves substantially as a gas lift when evolved into the tubular 12. When the pressure within the interior 50 of the tubular 12 decreases due to the introduction of gas through the port 28, the difference between the pressure in the gas hydrate 18 (which remains substantially constant outside the area in immediate proximity to the port 28) and the pressure within the tubular 12 increases. In other words, the differential pressure increases. The port 30, which is designed to open when the differential pressure reaches the second differential pressure greater than the first differential pressure, then opens. The port 28, which has already been producing gas therethrough, remains open at the second differential pressure. As can be understood, the gas from ports 28 and 30 combine to lower the interior pressure even further until the differential pressure reaches the third differential pressure and the port 32 is opened. Thus, a system is provided in which production automatically begins at the most downhole port, e.g. port 28, and the production itself serves to successively open uphole ports, e.g. 30 and then 32, based on increasing differential pressure.

Figure 2A:
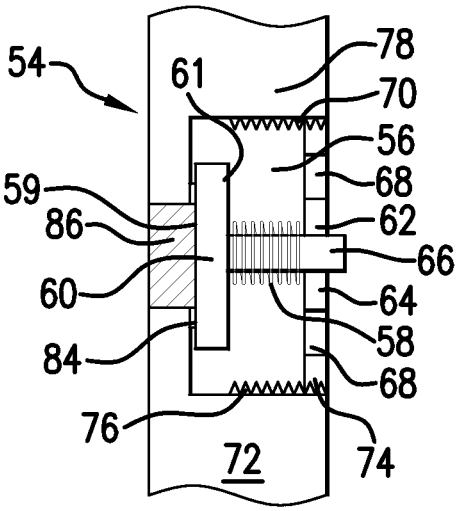
FIG. 2A shows a cross-sectional view of an exemplary embodiment of an active valve for the system of FIG. 1 in a closed condition.
Figure 2B:
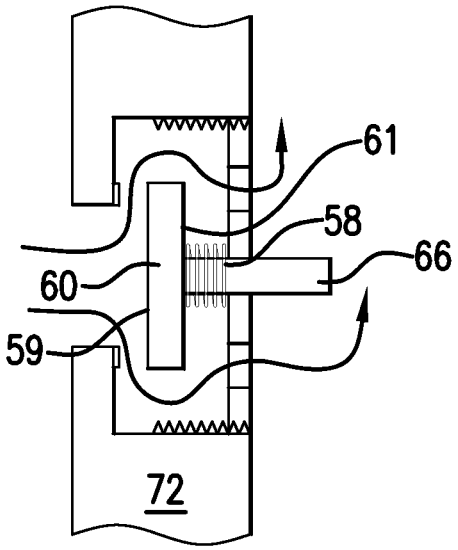
FIG. 2B shows a cross-sectional view of the active valve in an open condition.

One exemplary embodiment for accomplishing the distribution of ports 26 activated by selected differential pressures incorporates active valves 54 in a fluidic connection with the interior 50 and the exterior 52 of the tubular 12, where the interior 50 of the tubular is experiencing reduced pressure by the pressure reducing mechanism 34, and the exterior 52 of the tubular 12 is experiencing formation pressure of the gas hydrate 18. In the illustrated embodiment shown in FIGS. 2A and 2B, the ports 26 are provided with active valves 54, including, for example, spring valves 56 including a spring 58, a valve blocking member 60, and a spring support 62. FIG. 2A shows the valve 56 in a closed position such that the valve 56 blocks fluid communication through the port 26 between the interior 50 of the tubular 12 and the gas hydrate 18. FIG. 2B shows the valve 56 in an open position such that the port 26 is unblocked and the disassociated methane gas and water pass through the port 26. While a spring 58 is illustrated for the valve 56, alternative biasing means may be provided that are capable of biasing the valve blocking member 60 into position. The valve blocking member 60 is illustrated as a valve disc, however an alternative blocking member may be provided such as, but not limited to, a ball, a cone, etc, so long as the valve opening matches the valve blocking member 60. Also, since the formation pressure is greater than the interior tubular pressure, a blocking face 59 of the valve blocking member 60 is arranged to face the gas hydrate 18 while a spring engaging face 61 of the valve blocking member 60 is arranged to face the spring. The spring support 62 is illustrated as a perforated guide 64 for a valve rod 66. The valve rod 66, extending from the valve blocking member 60, is slidably supported within the perforated guide 64. The perforated guide 64 further includes perforations 68 for exposing the valve blocking member 60, in particular the spring engaging face 61 of the valve blocking member 60, to the internal tubular pressure, and for providing a passage for fluid (e.g. gas and water) when the valve 56 is in the open condition shown in FIG. 2B. The perforated guide 64 serves as a spring support to support the spring 58 between the guide 64 and the spring engaging face 61 of the valve blocking member 60. An outer periphery 70 of the perforated guide 64 may be welded or otherwise permanently secured within the tubular wall 72. Alternatively, an outer periphery 70 of the guide 64 may include threads 74 and the guide 64 may be threaded into a threaded opening 76 of the port 26. Providing such threads 74 affords the opportunity to easily adjust the initial compression of the spring 58, or even replace the spring 58 with one having a different spring constant.

Figure 3:
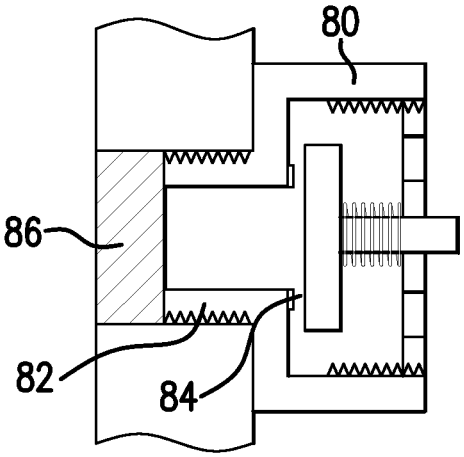
FIG. 3 shows a cross-sectional view of another exemplary embodiment of an active valve for the system of FIG. 1; and, FIG. 4 shows a cross-sectional view of another exemplary embodiment of an active valve for the system of FIG. 1.

The valve housing 78 in FIGS. 2A and 2B is formed by the tubular wall 72, although as shown in FIG. 3, a valve housing 80 may alternatively be separate from the tubular wall 72. The valve housing 80 in FIG. 3 includes a threaded attachment portion 82 that may be threaded into the port 26, or alternatively the valve housing 80 may be welded or otherwise secured to the tubular wall 72. The valve housing 78 shown in FIGS. 2A and 2B is advantageous in that the effect on the inner diameter of the tubular 12 is limited, however the valve housing 80 shown in FIG. 3 is simple to accommodate on existing tubulars 12.

In the illustrated embodiment, a seal 84 is provided between the valve blocking member 60 and the tubular wall 72 (or between the valve blocking member 60 and the valve housing 80 in FIG. 3) for preventing premature fluid communication. Also, the tubular wall 72 may be provided with an optional dissolvable member 86 that protects the valve blocking member 60 from inadvertent dislodgement from the tubular wall 72 during run-in.

The force required to open the valve 56 is dependent upon the spring constant of the spring 58 in the valve 56. Thus, the spring constant for a spring 58 in a valve 56 for port 28 is selected to be less than the spring constant for a spring 58 in a valve 56 for port 30, which will be less than the spring constant for a spring 58 in a valve 56 for port 32. Thus, as noted above, the differential pressure that can open the port 28 is less than the differential pressure that can open port 30, which are both less than the differential pressure that can open port 32.

Figure 4:
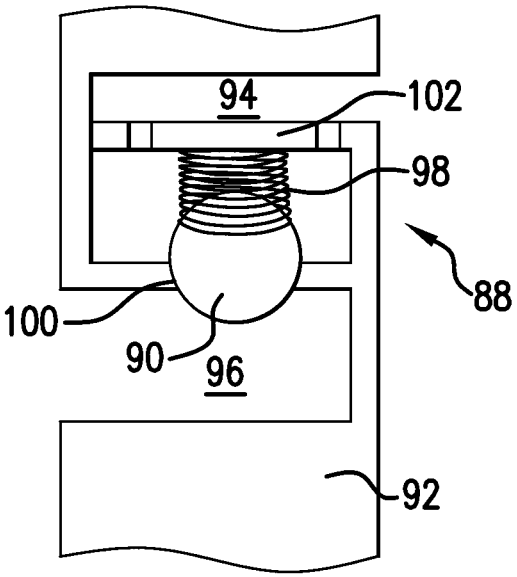

While a spring valve 56 activatable using a radially directed force has been shown in FIGS. 2 and 3, FIG. 4 shows an exemplary embodiment of an active valve 88 which operates using a longitudinal motion. For exemplary purposes, a valve blocking member 90 is shown as a ball and a valve housing 92 is formed by the tubular wall 72. The internal pressure is shared within recess 94, while the formation pressure is shared within recess 96. When the differential pressure is sufficient to overcome the spring 98, the valve blocking member 90 is longitudinally displaced to reveal the port opening 100 and water and gas may pass through the apertured spring plate 102 to pass through recess 94 and into the tubular 12. As with the valve 56, valve 88 may also be provided with a separable housing that is attachable to a port 26 in the tubular 12, and the blocking member 90 may be replaced by other shaped blocking members.

A method of improving gas hydrate production, such as methane hydrate production, using the system 10 thus includes inserting the ported tubular 12 into the borehole 14, aligning first and second ports 28, 30 with at least one band of methane hydrate 18, the second port 30 positioned uphole of the first port 28, opening the first port 28 when a first differential pressure between the interior 50 of the tubular 12 and the at least one band of methane hydrate 18 is reached, maintaining the second port 30 in a closed condition at the first differential pressure, and opening the second port 30 at a second differential pressure greater than the first differential pressure. The system 10 and method thereof enable automatic production of methane hydrate from a downhole port successively to an uphole port for a more complete production of the band of methane hydrate 18 than would be possible without this system 10.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A system for gas hydrate production, the system comprising:

a tubular having a plurality of ports, the plurality of ports including:

a first port configured to automatically open at a first differential pressure between an interior of the tubular and a band of gas hydrate, and to remain closed at differential pressures below the first differential pressure; and, a second port configured to remain closed at the first differential pressure, and to automatically open at a second differential pressure between the interior of the tubular and the band of gas hydrate, the second differential pressure greater than the first differential pressure, the second port located uphole of the first port; and, a pressure reducing mechanism within the tubular, the pressure reducing mechanism located uphole of the first and second ports, the pressure reducing mechanism configured to reduce internal pressure within the tubular and across both the first and second ports;

wherein the second differential pressure to open the second port is achieved via introduction of gas from the band of gas hydrate through the first port, which lowers the internal pressure within the tubular.

2. The system of claim 1, further comprising first and second active valves in fluidic communication with the first and second ports, the first and second active valves operable at the first and second differential pressures to open the first and second ports, respectively.

3. The system of claim 2, wherein the first and second active valves are spring valves, and a spring in the first active valve has a smaller spring constant than a spring in the second active valve.

4. The system of claim 3, wherein the first and second spring valves each include a blocking member biased to close the respective port by the first and second springs, respectively, and an apertured spring support configured to provide fluidic communication between the interior of the tubular and an interior of the respective spring valve.

5. The system of claim 2, wherein the first and second active valves include valve housings that are separately secured to the first and second ports, respectively.

6. The system of claim 2, wherein the first and second valves each include a valve blocking member biased to block the port to prevent fluid from the band of gas hydrate from entering the interior of the tubular.

7. The system of claim 1, wherein the pressure reducing mechanism is an electrical submersible pump.

8. The system of claim 7, wherein the pump is positioned within a conduit within the tubular.

9. The system of claim 1, further comprising at least three longitudinally displaced ports, wherein a differential pressure required to open each of the at least three longitudinally displaced ports is dependent on longitudinal location.

10. A method of improving methane hydrate production, the method comprising:

inserting a ported tubular into a borehole;

aligning first and second ports with at least one band of methane hydrate, the second port positioned uphole of the first port;

reducing pressure within the tubular and across both the first and second ports with a pressure reducing mechanism located uphole of the second port;

automatically opening the first port when a first differential pressure between an interior of the tubular and the at least one band of methane hydrate is reached;

maintaining the second port in a closed condition at the first differential pressure;

increasing differential pressure from the first differential pressure to a second differential pressure by introducing methane gas through the first port, wherein the methane gas reduces pressure within the interior of the tubular; and, automatically opening the second port at the second differential pressure between the interior of the tubular and the at least one band of methane hydrate, the second differential pressure greater than the first differential pressure.

11. The method of claim 10 wherein the pressure reducing mechanism is an electrical submersible pump.

12. The method of claim 10 further comprising employing the pressure reducing mechanism within a conduit within the tubular and positioning the pressure reducing mechanism uphole of the second port.

13. The method of claim 10 further comprising fluidically connecting first and second active valves with the first and second ports, respectively, the first and second active valves operable at the first and second differential pressures to open the first and second ports, respectively.

14. The method of claim 13, wherein the first and second active valves are spring valves, the method further comprising employing a spring in the first active valve that has a smaller spring constant than a spring in the second active valve.

15. A method of improving production in a downhole environment, the method comprising:

inserting a ported tubular into a borehole;

aligning first and second ports in the tubular with at least one band of natural resources, the second port positioned uphole of the first port;

reducing pressure within the tubular and across both the first and second ports with a pressure reducing mechanism located uphole of the second port;

automatically opening the first port when a first differential pressure between an interior of the tubular and the at least one band is reached;

maintaining the second port in a closed condition at the first differential pressure;

reducing pressure within the interior of the tubular by introducing natural resources through the first port and into the interior, and increasing differential pressure from the first differential pressure to a second differential pressure by introducing gas from the at least one band through the first port; and, automatically opening the second port at the second differential pressure between an interior of the tubular and the at least one band, the second differential pressure greater than the first differential pressure.

16. The method of claim 15, further comprising fluidically connecting first and second active valves with the first and second ports, respectively, the first and second active valves operable at the first and second differential pressures to open the first and second ports, respectively.

17. The method of claim 16, wherein the first and second active valves are spring valves, the method further comprising employing a spring in the first active valve that has a smaller spring constant than a spring in the second active valve.

18. The method of claim 15, wherein the tubular within the borehole includes a lateral portion and a vertical portion, wherein aligning first and second ports in the tubular with at least one band of natural resources includes aligning first and second ports in the lateral portion of the tubular with one band of natural resources.

* * * * *